US006213024B1

(12) United States Patent
Jasper, Jr. et al.

(10) Patent No.: US 6,213,024 B1
(45) Date of Patent: Apr. 10, 2001

(54) PROJECTILE WITH AN AIR PRESSURE WAVE GENERATOR AND CHEMICAL AGENT/MARKER

(75) Inventors: Louis J. Jasper, Jr., Fulton; George K. Lucey, Jr., Burtonsville; Thomas J. Gher, Laurel; Louis E Jasper, Fulton, all of MD (US)

(73) Assignee: United States of America, Washington, DC (US)

( * ) Notice: Subject to any disclaimer, the term of this patent is extended or adjusted under 35 U.S.C. 154(b) by 0 days.

(21) Appl. No.: 09/162,390

(22) Filed: Sep. 28, 1998

(51) Int. Cl.[7] ..... F42B 12/02; F42B 13/36
(52) U.S. Cl. ..... 102/502; 102/512
(58) Field of Search ..... 102/702, 503, 102/513, 473, 499, 502, 501, 512

(56) References Cited

U.S. PATENT DOCUMENTS 3,578,011 * 5/1971 Holmes ..... 102/499
3,906,860 * 9/1975 Johns ..... 102/476
4,020,765 * 5/1977 Glass ..... 102/201
4,221,167 * 9/1980 Berlin ..... 102/334
4,259,906 * 4/1981 Krauch, Jr. et al. .
4,359,943 * 11/1982 Majerus ..... 102/309
4,485,742 * 12/1984 Mamo ..... 102/430
4,961,382 * 10/1990 Bai et al. ..... 102/476
5,363,766 * 11/1994 Brandon et al. ..... 102/374

* cited by examiner

*Primary Examiner*—Peter M. Poon
*Assistant Examiner*—James S. Bergin
(74) *Attorney, Agent, or Firm*—Paul Clohan

(57) ABSTRACT

A projectile with an Air Pressure Wave Generator, a battery, fuze, safe and arm system, detonator system, and ancillary circuitry. The Air Pressure Wave Generator contains a supersonic or subsonic nozzle, an ogive, and a secondary propellant chamber, which contains a conventional high explosive and is consistent with the "form-fit" of the weapon rifling system, and designed so as to produce the desired Air Pressure Wave impulse on the target. The projectile also has chemical agent(s) and marker(s) inside the secondary propellant chamber, and/or inside the Air Pressure Wave Generator section that is located intermediate between the nozzle and projectile housing. The types and amounts of chemical agent(s) and marker(s) are consistent with the Air Pressure Wave Generator design to entrap the chemical agent(s) and marker(s) in the core or central section of the APW packet. The properties and parameters of the chemical agent(s) and marker(s) are chosen to produce the desired target effects and minimize unwanted spillage.

4 Claims, 2 Drawing Sheets

PROJECTILE WITH AN AIR PRESSURE WAVE GENERATOR AND CHEMICAL AGENT/MARKER

RIGHTS OF THE GOVERNMENT

The invention described herein may be manufactured, used, and licensed by or for the United States Government for governmental purposes without the payment to us of any royalty thereon.

BACKGROUND OF THE INVENTION

1. Field of the Invention

This invention relates to military and law enforcement high-power air (gas) pressure waves, vortex-ring gas pressure waves, gas pressure wave generators, and propagation.

2. Discussion of Related Art

Non-lethal (NL) weapons are being developed for use in controlling and/or isolating personnel, incapacitating personnel, seizing personnel, and for crowd control. Air pressure waves affect personnel through propagation in the air, resonant coupling onto body organs, and blunt impulses. Also, chemical (both lethal and NL) agents and markers may be precision-delivered to personnel using air pressure waves such as a vortex-ring by trapping the chemical agents and markers in the wave packet and dispensing them in the direct vicinity of the targeted personnel by direct impact with the target. Target effects may vary from a noticeable response, an uncomfortable response, incapacitation, injury, and death.

Many varieties of NL weapons are being considered, designed, and built for antipersonnel applications. These weapons have characteristics aimed at accomplishing a certain function. For example, a vortex-ring generator is suited for delivering air impulses over a large area of the body, and chemical agents, and markers onto targeted personnel with precision and accuracy. On the other hand, a sponge grenade or a bean bag is suited for delivering a blunt impact over a small area of the body with precision and accuracy at ranges out to 50-m. The choice of the NL technology used is scenario and objective dependent. Of extreme importance is the range from source to target. Air pressure wave generators (APWGS) will be most effectively used at source to target ranges less than about 100-m due to a number of reasons. Several of these reasons are size and weight constraints for the APWG, chemical agent and marker spillage during propagation, and atmospheric attenuation and dispersion due to wind, rain, snow, and etc. Crosswind dispersal and wind gust shattering can cause spillage and the air pressure wave (APW) and its chemical agents and markers to miss the target. The atmospheric considerations are extremely important in APW propagation; therefore, it is highly desirable to place the APWG as close to the target as possible and feasible in order to minimize energy loss and chemical spillage. This can be accomplished by flying the APWG on air platforms i.e., airplanes, unmanned aerial vehicles (UAVs), or by transporting the APWG around on platforms trucks, unmanned ground vehicles (UGVs), and robotic platforms. Another technique is to use a chemical explosion to generate and place APWGs in the vicinity of the target. This technique is inexpensive and does not require an air, ground, or sea platform to transport the APWG.

SUMMARY OF THE INVENTION

Accordingly, it is an object of the present invention to provide an improved means of placing a high-power APWG in the vicinity of targets in a highly effective manner by using a compact projectile which contains an expendable APWG, chemical agents, and markers. The primary function of the projectile is to produce NL effects on personnel at ranges commensurate with the weapon platform capability. For example the MK19-3 and STRIKER 40-mm grenade launchers can fire a grenade out to a maximum of about a 2-km range. The Objective Individual Combat Weapon (OICW) can fire a 20-mm projectile cut to a range of about 1-km. Objective Crew-Served Combat Weapon (OCCW) can fire a 25 mm projectile out to a range of about 2-km.

It is another object of the invention to minimize energy loss and chemical agent and marker spillage as the APW propagates to the target, by placing the APWG in close proximity to the target, thereby, greatly reducing the distance from generator to target.

It is another object of the invention to improve the target accuracy of the APW impulse and its corresponding chemical agents and markers by placing the APWG in close proximity to the target, thereby, greatly reducing the distance from generator to target.

It is a further object of the invention to extend the target effects range capability of the APWG by generating the APW in the vicinity of the target, thereby eliminating a bulky weapon platform which would be required if the APWG were at large distances from the target.

It is a further object of the invention to give tunable target effects by predetermining the distance of the APWG to the target via a "smart" projectile that uses a computer, rangefinder, and timing fuze means. Target effects may vary from a noticeable response, to an uncomfortable response, to incapacitation, to injury, and finally to death.

The foregoing and other objects are achieved by a projectile that is delivered at a predetermined distance to the target by rangefinder, computer, and conventional propellant means, or other more advanced launching means such as all electric power, thermal power, or hybrids thereof. An additional propellant and fuze means are used to activate an APWG, which generates an APW in the vicinity of the target and at a predetermined distance from the target. The projectile, also has means for containing chemical agents and markers that are delivered to the target by the APW trapping the chemical agents and markers in the core or central section of the APW packet.

BRIEF DESCRIPTION OF THE DRAWINGS

The invention will be better understood, and further objects, features, and advantages thereof will become more apparent from the following description of the preferred embodiment, taken in conjunction with the accompanying drawings in which.

DETAILED DESCRIPTION OF THE PREFERRED EMBODIMENTS

The preferred embodiment of the invention uses a projectile that is "form-fit" with the weapon platform. The invention utilizes a laser rangefinder or other means to determine the distance from the weapon platform to the target. The invention also uses a computer, fuze, and sensor means to locate the target, to determine the time of projectile flight to the target, and to detonate the propellant and activate the APWG at the desired distance to the target.

These items are needed to produce the desired APW impulse and/or chemical agents and/or markers on target. The computer, fuze, laser rangefinder, and sensor means are standard items well understood in the art and are utilized to accurately place the projectile in vicinity of the target and to activate the APWG at the predetermined time and distance from the target. The projectile has a primary propellant chamber which contains a conventional propellant and an amount and packing density that are consistent with the weapon platform. The projectile also has a secondary propellant chamber, which contains a conventional propellant, and an amount and packing density that are consistent with the APWG. The projectile also contains a battery, fuze, safe and arm system, detonator system, and ancillary circuitry that are consistent with the weapon platform's rangefinder, computer, and ancillary circuitry. The projectile also contains an APWG that is consistent with the "form-fit" of the weapon rifling system, and designed so as to produce the desired APW impulse on the target. The projectile also has chemical agent(s) and marker(s) inside the secondary propellant chamber, and/or inside the APWG section (the region located intermediate with the nozzle and projectile housing) that are consistent with the APWG design to entrap the chemical agent(s) and marker(s) in the core or central section of the APW packet. The properties and parameters of the chemical agent(s) and marker(s) are chosen to produce the desired target effects and minimize unwanted spillage.

Figure 1:
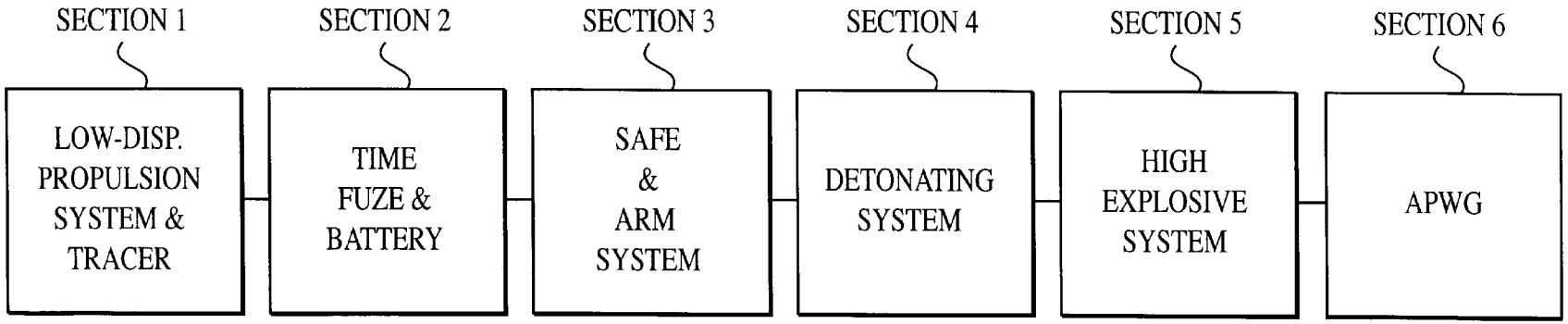
FIG. 1 is a block diagram of the APWG Projectile System.

FIG. 1 is a block diagram of the APWG projectile system. Sections 1, 2, 3, 4, and 5 involve projectile technologies that already exist, but may require engineering changes due to different locations of some systems inside the projectile. For example, the STRIKER 40-mm Advanced Lightweight Grenade Launcher uses a projectile where the time fuze is in the frontal section of the projectile. For this invention, the APWG must be in the frontal section of the projectile.

Figure 2:
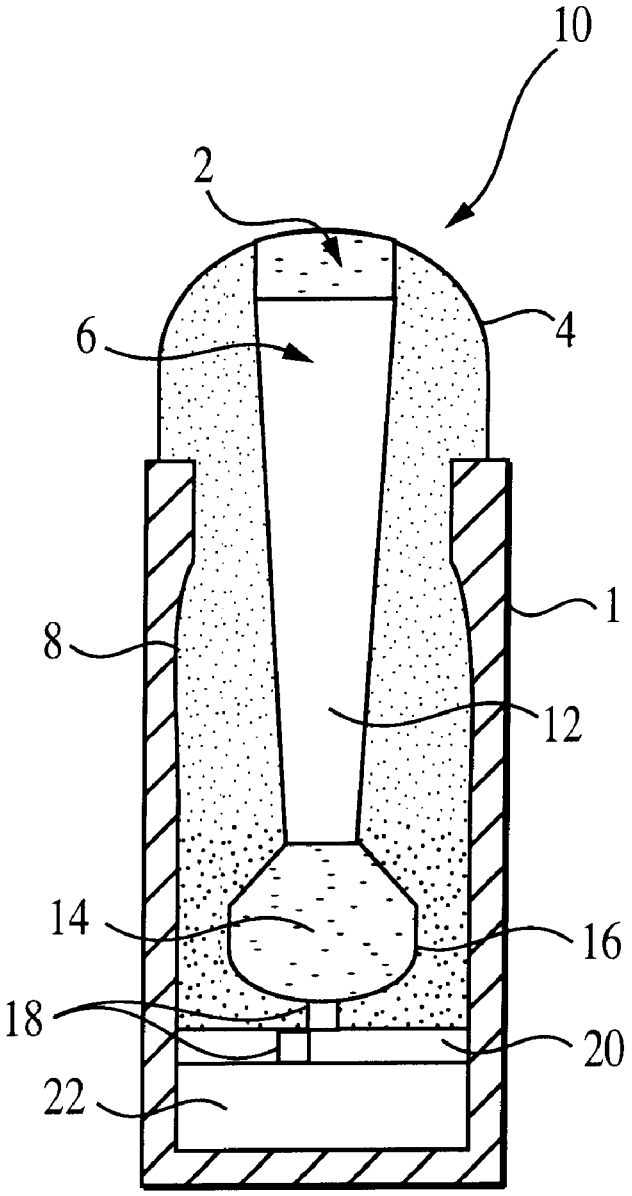
FIG. 2 is an inside view of sections 2 thru 6 of the APWG Projectile System.

FIG. 2 is a cross-sectional view of APWG projectile system 10. It is essentially an inside view of sections 2 thru 6 (the projectile systems that fly). In FIG. 2, the High Explosive System consists of a high explosive 14 (i.e., a propellant), a combustion chamber 16, and a rupturable disk 12. The APWG consists of a supersonic or subsonic nozzle 6 (divergent or convergent) with an inlet (throat) opening, a tapered inner wall, an outer wall ("form-fit" with the 40-mm projectile 4), an outer opening, and a removable ogive 2. FIG. 2 shows a supersonic (divergent) nozzle. Also shown in FIG. 2 are standard items projectile housing 1, rotating band 8, detonator system 18, safety and arming device 20, and time fuze/battery 22. The physical parameters of the APWG, and the specific heat and pressure ratios are given below for a 40-mm projectile. The nozzle geometry and propellant parameters are typical values, and changes to these parameters can be made and still be "form-fit" with a 40-mm projectile. Other design changes are evident to those skilled in the art.

The physical parameters of the APWG (section 6) and the pressure and specific heat ratios of the High Explosive System (section 5) that were used in a 40-mm projectile are:

Nozzle outer diameter=0.75 inch

Nozzle inner diameter=0.125 inch

Nozzle length=2 inches

Nozzle pitch (half) angle=8.9 degrees

Specific heat ratio, $\gamma$=1.226

Propellant pressure in combustion chamber/atm. Pressure, $P_o/P_{atm}$=2000

$\gamma$ is the ratio of the specific heat at constant pressure/constant volume. The physical parameters of the divergent nozzle are calculated using steady-state, steady-flow fluid dynamic equations. The nozzle geometrical factor (NGF) is $$NGF = \left\{ \frac{\left( \frac{2}{\gamma+1} \left( \frac{P_0}{P_{atm}} \right)^{\frac{\gamma-1}{\gamma}} \right)^{\frac{\gamma+1}{4(\gamma-1)}}}{\left( \frac{2}{\gamma-1} \left( \frac{P_0}{P_{atm}} \right)^{\frac{\gamma-1}{\gamma}} - 1 \right)^{1/4}} \right\} - 1$$

NGF=(2L/D)Tan($\theta$) where L is the nozzle length, D is the diameter of the nozzle inlet (throat), and $\theta$ is the half angle of the nozzle. Since the above equation is derived from steady-state, steady-flow fluid dynamics, it will give an approximate value for the NGF. This NGF value is used as input data to an Adaptive Research Computational Fluid Dynamics CFD 2000 program to simulated APW flow. The above equation is simplified to $$NGF = C\left(\frac{P_0}{P_{atm}}\right)^d$$

Where C=−0.1 2 $\gamma$+0.5 and d=½$(\gamma)^{-5/8}$. The two equations are within reasonable agreement, with the NGF having a mean variation between both equations of about 4% over a range of pressure ratios from 2000 to 110,000 and over a range of gamma ratios from 1.1 to 2.1.

It will be readily seen by one of ordinary skill in the art that the present invention fulfills all of the objects set forth above. After reading the foregoing specification, one of ordinary skill will be able to effect various changes, substitutions of equivalents and various other aspects of the present invention as broadly disclosed herein. It is therefore intended that the protection granted hereon be limited only by the definition contained in the appended claims and equivalents thereof.

Having thus shown and described what is at present considered to be the preferred embodiment of the present invention, it should be noted that the same has been made by way of illustration and not limitation. Accordingly, all modifications, alterations and changes coming within the spirit and scope of the present invention are herein meant to be included.

We claim:

1. A non-lethal projectile comprising:

a projectile housing;

an air pressure wave generator for generating an omni-directional, vortex ring, air pressure wave impulse within said housing;

said projectile housing having contained therein a propulsion system, a timing fuze, a battery, a safe and arm system, a detonating system and a high explosive system.

2. The non-lethal projectile of claim 1 wherein said air pressure wave generator for generating an omni-directional, vortex ring, air pressure wave impulse comprises:

a supersonic nozzle;

an ogive on one end of said nozzle;

an explosive within a combustion chamber at the other end of said nozzle;

a rupturable disk at the nozzle/combustion chamber interface to confine said explosive within said combustion chamber for a predetermined period of time after ignition.

3. The non-lethal projectile of claim 2 further comprising a chemical agent within said air pressure wave generator.

4. The projectile of claim 1 wherein said air pressure wave generator comprises:

a subsonic nozzle;

an ogive on one end of said nozzle;

an explosive within a combustion chamber at the other end of said nozzle;

a rupturable disk separating said explosive and said nozzle.

* * * * *